US008909097B2

(12) United States Patent
Martin et al.

(10) Patent No.: US 8,909,097 B2
(45) **Date of Patent: *Dec. 9, 2014**

(54) SYSTEMS AND METHODS FOR REMANUFACTURING IMAGING COMPONENTS

(71) Applicant: Static Control Components, Inc., Sanford, NC (US)

(72) Inventors: Jonathan W. Martin, Fayetteville, NC (US); Donald R. Huck, Sanford, NC (US); Patrick J. Novak, Raleigh, NC (US)

(73) Assignee: Static Control Components, Inc., Sanford, NC (US)

( * ) Notice: Subject to any disclaimer, the term of this patent is extended or adjusted under 35 U.S.C. 154(b) by 57 days.

This patent is subject to a terminal disclaimer.

(21) Appl. No.: 13/720,392

(22) Filed: Dec. 19, 2012

(65) Prior Publication Data

US 2014/0133883 A1 May 15, 2014

Related U.S. Application Data

(60) Provisional application No. 61/726,068, filed on Nov. 14, 2012.

(51) Int. Cl.

| | |
|---|---|
| ***G03G 21/16*** | (2006.01) |
| ***G03G 15/00*** | (2006.01) |
| ***G03G 15/08*** | (2006.01) |

(52) U.S. Cl.

CPC ..... *G03G 15/0894* (2013.01)
USPC ..... 399/111; 399/109

(58) Field of Classification Search

USPC ..... 399/107, 109, 110, 111, 119
See application file for complete search history.

(56) References Cited

U.S. PATENT DOCUMENTS

| | | | | |
|---|---|---|---|---|
| 6,904,348 | B2 * | 6/2005 | Drummond et al. | 701/49 |
| 7,380,904 | B2 | 6/2008 | O'hara et al. | |
| 7,424,245 | B2 * | 9/2008 | Burchette et al. | 399/109 |
| 7,588,318 | B2 | 9/2009 | O'hara et al. | |
| 7,917,056 | B2 * | 3/2011 | Burchette et al. | 399/109 |
| 8,160,473 | B2 * | 4/2012 | Swartz et al. | 399/109 |
| 8,160,474 | B2 * | 4/2012 | Burchette et al. | 399/109 |
| 2012/0062662 | A1 | 3/2012 | Olsen | |

* cited by examiner

*Primary Examiner* — Anh T. N. Vo

(57) ABSTRACT

Techniques for modifying an imaging cartridge includes providing the imaging cartridge comprising a body including a circuit holding structure sized to hold an electronic circuit and forming a modified circuit holding structure, with the modified circuit holding structure sized to hold a replacement electronic circuit. At least one dimension of the replacement electronic circuit may be greater than a corresponding dimension of the electronic circuit.

7 Claims, 23 Drawing Sheets

SYSTEMS AND METHODS FOR REMANUFACTURING IMAGING COMPONENTS

This application claims the benefit of previously filed U.S. Provisional Patent Application No. 61/726,068, which was filed on Nov. 14, 2012.

BACKGROUND

The present invention generally relates to manufacturing, remanufacturing or repairing replaceable imaging components, and more particularly to apparatus and techniques for modifying a replaceable imaging cartridge to operate with a replacement electronic circuit.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, facsimile machines and the like, for example. Imaging cartridges, once spent, are unusable for their originally intended purpose. Without a refurbishing process these cartridges would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the imaging cartridge.

Some imaging cartridges may include a chip having a memory device which is used to store data related to the cartridge or the imaging device, such as a printer, for example. Typically a cartridge chip is a printed circuit board (PCB) having circuit components mounted thereon. The imaging device may communicate with the chip using a direct contact method or a broadcast technique utilizing radio frequency (RF) communication. This chip is typically mounted in a location, such as a slot, on the cartridge to allow for proper communication between the printer and the toner cartridge when the cartridge is installed in the printer. When the toner cartridge is being remanufactured, as described above, the chip provided by the original equipment manufacturer (OEM), such as Hewlett-Packard or Lexmark, may need to be replaced by a compatible chip developed by a third party. Such a replacement chip may be larger and not have the same physical form factor as the OEM chip and thus may not fit into the slot on the toner cartridge. Thus, it would be desirable to provide techniques for solving this problem and allowing a replacement chip having a different form factor be installed on the toner cartridge by, for example, modifying the toner cartridge to accept the replacement chip.

Some imaging devices have electrical contacts that are spring loaded or otherwise physically forced against the cartridge chip contacts. U.S. Pat. Nos. 7,380,904 and 7,588,318 and U.S. Pub. Patent Application No. 2012/0062662 are examples this type of imaging device. These documents are incorporated by reference. In these imaging devices, colors are printed using four color cartridges: black, cyan, magenta, and yellow. The four cartridges slide in a carriage mounted in the printer in order to feed ink to the document during the printing operation. The cartridges fit tightly into the carriage with little room for additional external components. Therefore, when replacing the original chip, the replacement chip and the installation process must allow continuing functionality without sacrificing size. In these devices, the cartridge chip may damage the imaging device electrical contacts if the cartridge chip is raised too much above the surface of the cartridge. Alternatively, if the cartridge chip is recessed too much within the cartridge surface, a secure electrical connection may not be achievable.

SUMMARY

The present system and method allows for a replacement cartridge chip to be installed in a used imaging cartridge while allowing for a proper electrical connection between the cartridge chip and the imaging device.

The method includes removing the old cartridge chip from the imaging device and removing any adhesive that remains when the chip is removed. A portion of the chip holding area is removed and a replacement cartridge chip is installed. The removal of a portion of the chip holding area allows for a replacement chip that is larger than the original chip to be used.

In one embodiment the method also includes using a tool, such as a jig, to help remove the proper amount of material from the cartridge. In this method, after the original chip is removed from the cartridge, the cartridge is placed within a jig having a hole or slot above the chip holding area of the cartridge. A drill bit (or an end mill) having a collar is inserted through the hole or slot and is used to remove a portion of the chip holding area. The drill bit (or end mill) is used to drill a hole in the chip holding area. The combination of the drill bit collar and the hole in the jig enables the remanufacturer to control the depth of the hole in the chip holding area. A replacement chip is then installed and adhered to the cartridge at the chip holding area. If the replacement chip leaves a gap and does not cover the entire removed portion then the gap needs to be filled or the imaging device electrical contacts may be damaged. The gap may be filled with material such as an adhesive, or a melted solid that hardens in place. Alternatively, the replacement chip can be shaped or sized to ensure that the replacement chip covers the gap or leaves no gap. Alternatively, a thin film can be placed over a portion of the replacement chip and the chip receiving area to cover the gap.

In an alternative embodiment, a smaller replacement chip or a replacement chip having smaller components is used and a smaller portion of the chip holding area is removed. In this embodiment, there is no gap left in the chip holding area.

Also disclosed is a kit utilized for performing the methods described above. The kit includes a jig having a hole or slot. The jig is sized to hold the imaging cartridge and the hole or slot is located above the chip holding area of a cartridge held in the jig. The kit also includes a drill bit having a stop collar. The drill bit may have a chamfered or beveled end in order to drill a smoother hole. The stop collar is used in combination with the hole or slot in the jig to control the depth of the hole drilled into the cartridge chip holding area. The kit may also include an adhesive, a chip removal tool, such as a knife, a thin film to cover a portion of the replacement chip and the chip receiving area, and a device to measure the dimensions of the replacement chip after it is secured onto the cartridge. Furthermore, the kit may include a dremel, a laser cutter, or any tool suitable to removing a portion of the chip holding area instead of a drill bit.

In this regard, before explaining at least one embodiment of the invention in detail, it is to be understood that the invention is not limited in its application to the details of construction and to the arrangements of the components set forth in the description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be used as a basis for designing other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The accompanying drawings, which are incorporated in and form a part of the specification, illustrate embodiments of the present invention and, together with the description, serve to explain the principles of the invention.

DETAILED DESCRIPTION

The following detailed description of preferred embodiments refers to the accompanying drawings which illustrate specific embodiments of the invention. In the discussion that follows, specific systems and techniques for repairing, manufacturing or remanufacturing an imaging cartridge, such as an HP 950 ink cartridge, are disclosed. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention.

Figure 1:
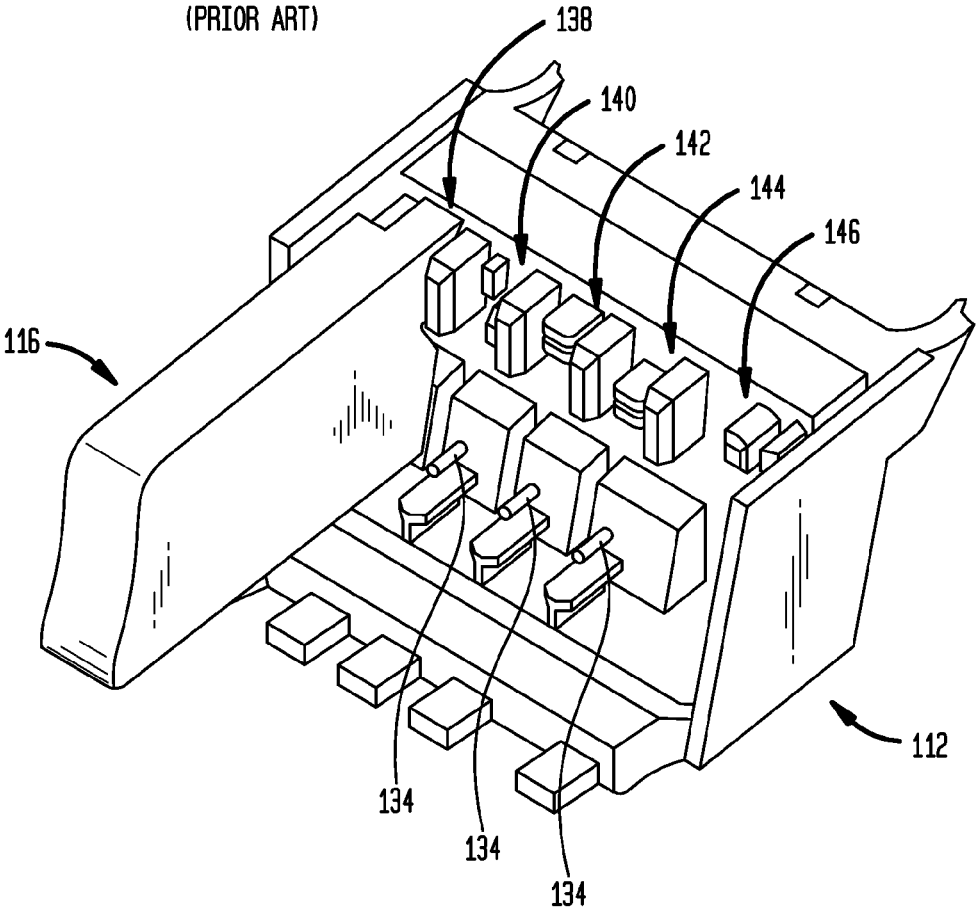
FIG. 1 (PRIOR ART)
FIG. 1 shows an imaging cartridge installed in a carriage.

FIG. 1 is perspective top and bottom views of one embodiment of a carriage 112 and a print head assembly of printer. An ink container 116 is positioned in carriage 112. The ink containers are not shown in order to illustrate the inlets 134 that connect to print head assembly and alignment features for ink containers 116. The print head assembly includes an ink inlet 34 positioned at each bay 138, 140, 142, 144, and 146 for a corresponding ink container. Print head assembly and carriage 112 may be integrated together to form a single component, or the print head assembly may be detachable from carriage 112.

Figure 2:
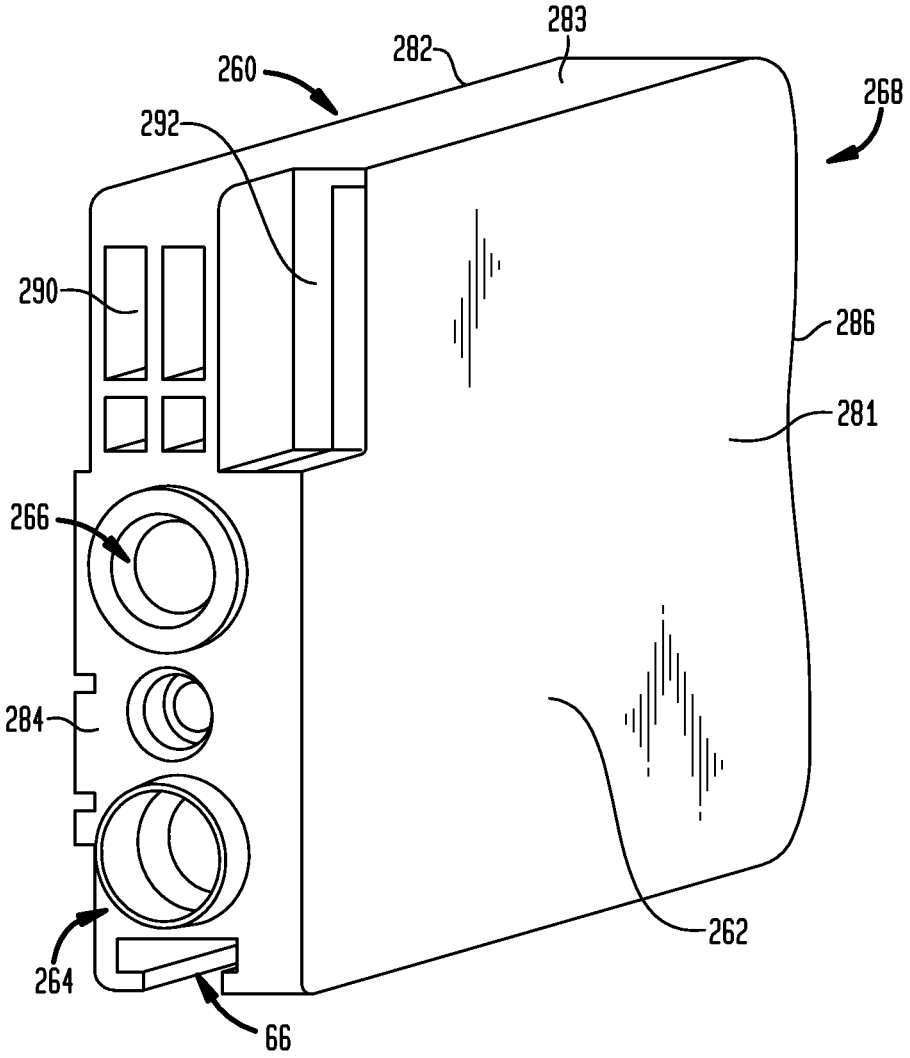
FIG. 2 (PRIOR ART)
FIG. 2 shows a perspective view of an ink container.

FIG. 2 is a perspective view of a printing fluid or ink container 260, such as the ink container 116 (FIG. 1). Ink container 260, includes a body or housing 262 and a quantity of printing fluid or ink contained within housing 262. Ink within housing 262 is supplied to a print head assembly. The ink container 260 may include a fluid interconnect 264 for supplying printing fluid or ink within ink container 260 to the print head assembly. The ink container may include one or more alignment features 266 for positioning ink container 260 in the carriage 112 and a keying feature 290 for ensuring that ink container is inserted in the correct bay of the carriage 112. The housing 262 has a rectangular shape 268 and includes opposite major surfaces 281 and 282, and sides 283, 284, 285, and 286 oriented substantially perpendicular to major surfaces 281 and 282. A fluid interconnect 264 and alignment features 266 may be formed on or in or communicate with side 284 of housing 262. Ink container 260 is inserted into carriage 112 into one of bays 138, 140, 142, 144, and 146 of carriage 112 (FIG. 2), in a direction substantially perpendicular to side 284 of housing 262.

In a color printer, each ink container 260 holds a different color ink, such as cyan, magenta, yellow, black, and photo black. Each ink container has a different keying structure 290. The keying structure 290 consists of elements that correspond to elements in the bays of the carriage 112. A cartridge for one color, for example cyan, has a different keying structure than a cartridge of another color, for example black. The keying structure prevents a cartridge from fitting in the wrong bay of the carriage. In this way, a user is prevented from accidentally inserting a cyan color cartridge into the bay that is intended for the yellow color cartridge.

Located adjacent to the keying structure 290, is the chip holding area 292. A cartridge chip (not shown) is secured to the chip holding area by an adhesive. The chip holding area has a chip pocket that original chip fits into. The pocket allows the chip to lay level with a surface of the chip holding area and helps orient and place the chip. The chip is oriented so that its electrical contacts are electrically connected to the print carriage 112 via spring loaded electrical contacts (not shown). The electrical connection allows the printer to power the cartridge chip and enables the cartridge chip to communicate with the printer.

Cartridge chips may be used for many purposes in the imaging industry. Often chips are used to ensure that the cartridge is compatible with the imaging device, to record and maintain a level of recording material located therein, such as ink or toner, or to authenticate that the cartridge is manufactured by an authorized manufacturer. Also, some manufacturers use cartridge chips to prevent cartridges from being reused, refilled, or remanufactured. In these instances, the cartridge chip contains data or information that indicates that cartridge has been previously used. This information is then communicated to the printer and the printer prevents the cartridge from being used for printing.

Therefore, it is often desirable or necessary to replace the original cartridge chip when refilling or remanufacturing an imaging cartridge. Furthermore, a replacement cartridge chip can contain customized data that better matches the characteristics of the imaging cartridge when it is refilled or remanufactured.

In order to replace the cartridge chip, the original chip must first be removed from the cartridge. The original cartridge chip may be removed using a rigid device such as a knife or a flat-head screwdriver. After the original chip is removed, the chip holding area should be cleaned of any residual parts or adhesive material. Often the original chip has electronic parts that remain attached to the imaging cartridge when the original chip is removed. The replacement chip may then be attached to the chip holding area with an adhesive or some other means. However, a replacement chip may be physically larger than the original chip due to the inclusion of a microcontroller unit (MCU) or a system on a chip (SOC) and thus not fit into the pocket on the chip holding area. The present methods provide techniques for solving this problem and allowing a replacement chip having a different form factor be installed on the imaging cartridge by, for example, modifying the imaging cartridge to accept the replacement chip.

Figure 3A:
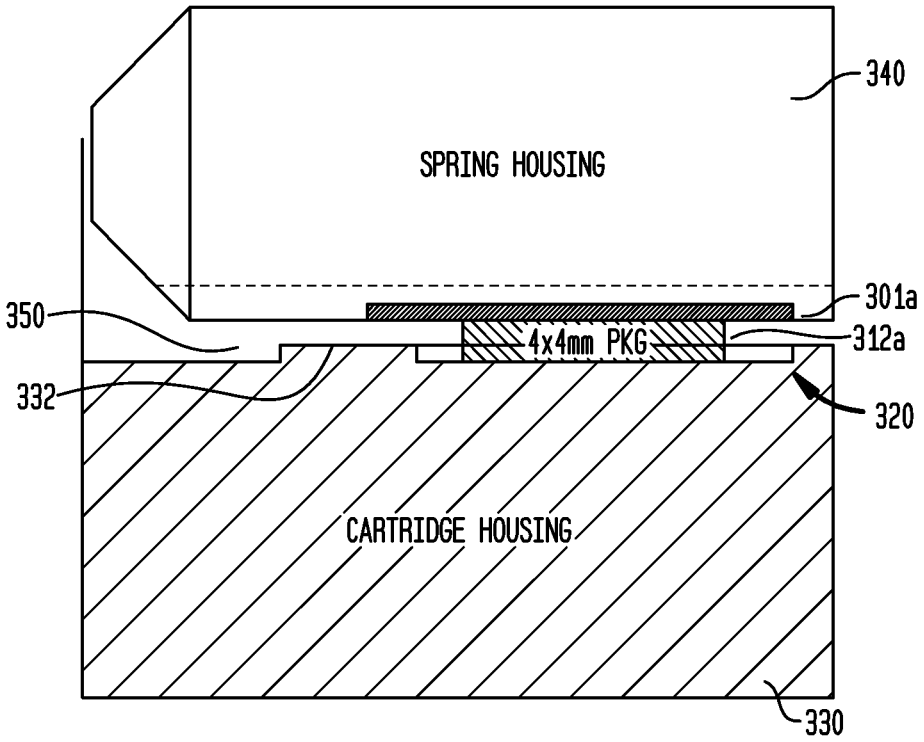
FIGS. 3A-3C show perspective views of a replacement chip and the chip holding area.
Figure 3B:
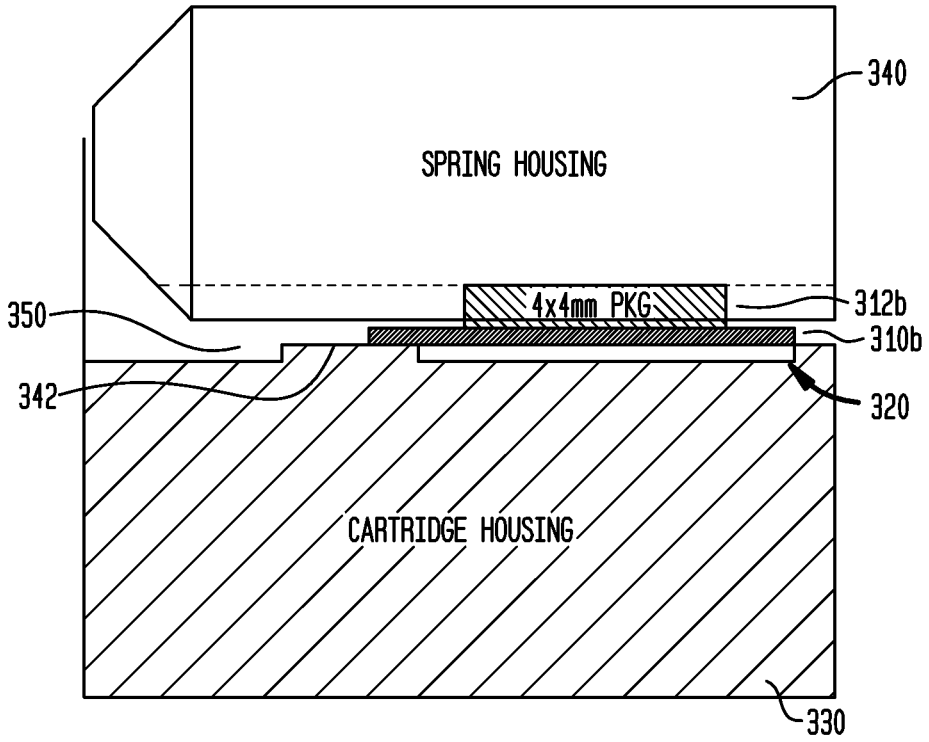

FIGS. 3A and 3B show perspective views of replacement chips that are too large for the pocket in the chip holding area. In FIG. 3A, a replacement chip 310*a* has a chip package 312*a* (containing chip electronics) located on a surface opposite the surface having the electrical contacts. The chip package 312*a* is too thick preventing the replacement chip 310*a* from fitting in the chip pocket 320 to sit flush with a surface 332 of the cartridge housing 330. A spring housing 340 is located on the printer carriage and includes one or more spring contacts 350. In operation, when the cartridge is inserted into the carriage, the spring contact 350 is pushed against the cartridge housing 330 at the chip holding surface 332. If the replacement chip 310*a* extends too far above the surface 332, the spring contact 350 may catch on the replacement chip 310*a* causing the spring contact 350 to be damaged or even pulled off the spring housing 340.

In FIG. 3B, a replacement chip 310*b* has a chip package 312*b* (containing chip electronics) located on the same surface as the surface having the electrical contacts. The chip package 312*b* is too thick preventing the replacement chip 310*b* from fitting in the chip pocket 320 to sit flush with a surface 332 of the cartridge housing 330. A spring housing 340 is located on the printer carriage and includes one or more spring contacts 350. In operation, when the cartridge is inserted into the carriage, the spring contact 350 is pushed against the cartridge housing 330 at the chip holding surface 332. If the replacement chip 310*b* extends too far above the surface 332, the spring contact 350 may catch on the replacement chip 310*b* causing the spring contact 350 to be damaged or even pulled off the spring housing 340. Another disadvantage to a replacement chip having the chip package 312*b* on the electrical contact surface is that the chip package 312*b* extends beyond the surface of the chip holding area and the replacement chip 310*b* does not fit or causes damage to the spring contact 350.

In order to prevent a replacement chip from damaging the spring contacts as shown in FIGS. 3A and 3B, it may be necessary to enlarge the chip pocket 320.

Figure 4A:
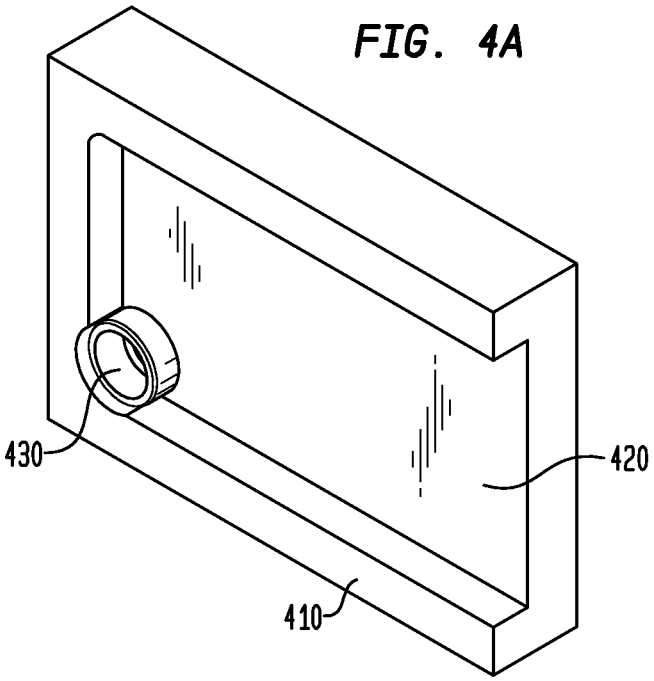
FIGS. 4A-4D illustrate a kit that is used to perform a chip replacement method.
Figure 4B:
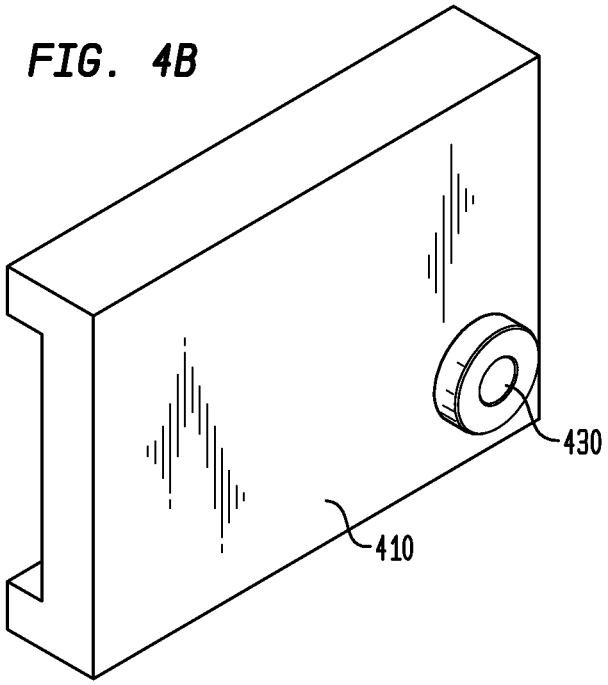
Figure 4C:
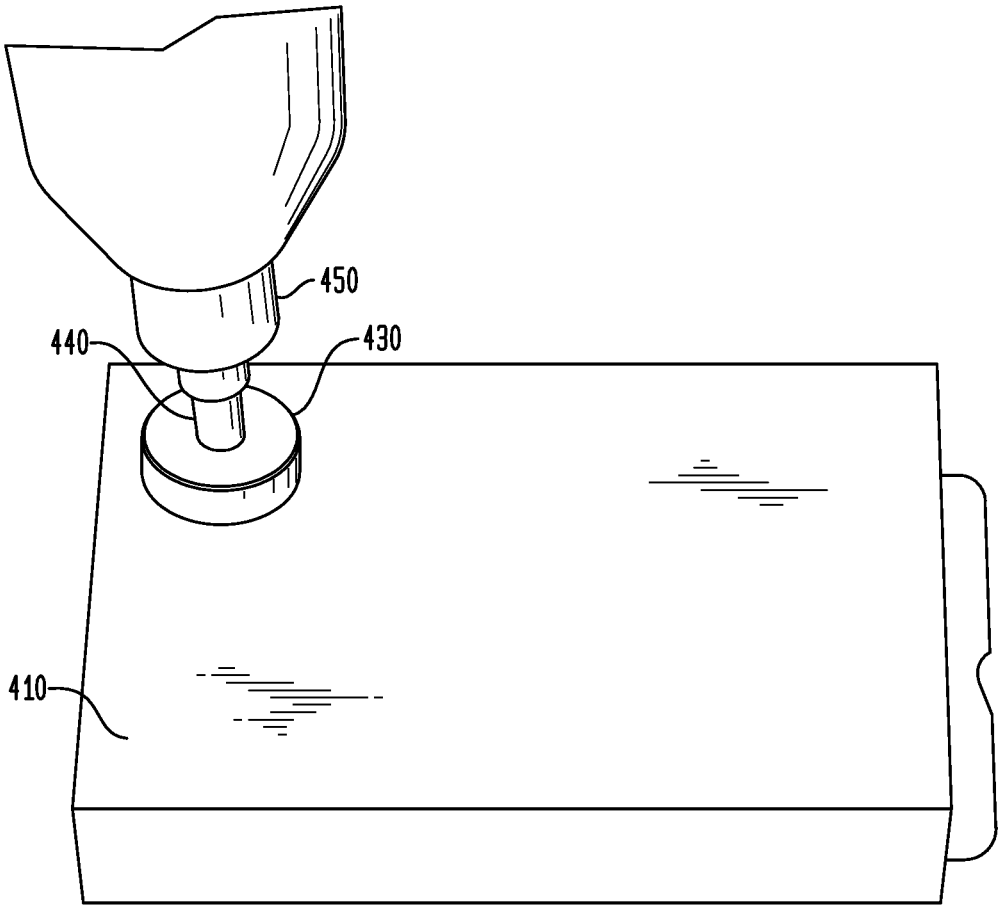
Figure 4D:
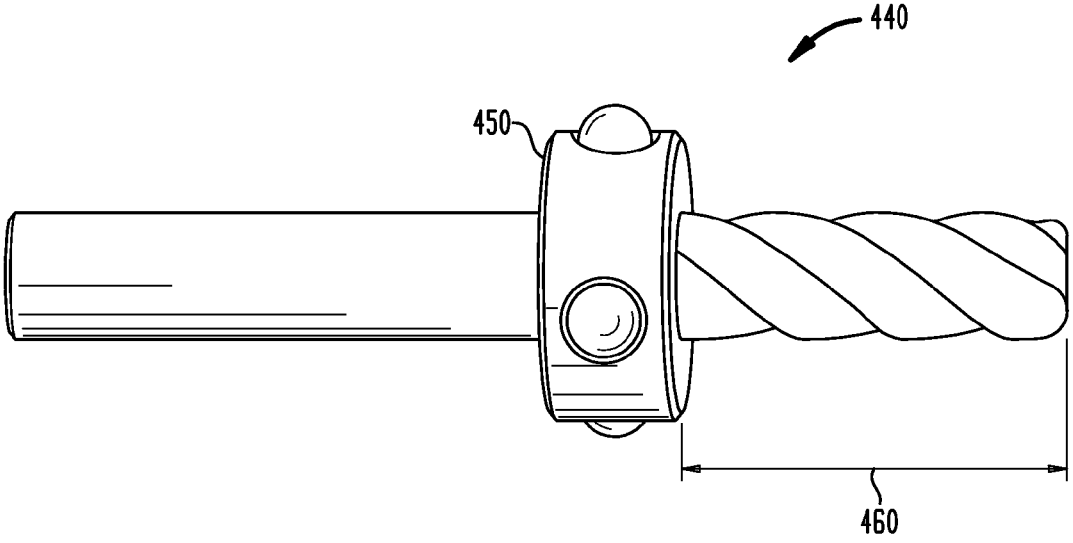

One method of enlarging the chip pocket will now be described. FIGS. 4A-D illustrate this method. In order to enlarge the chip pocket, some of the cartridge material must be removed. Furthermore, if any of the parts, such as the electronic circuitry, remains adhered to the imaging cartridge then these parts must be removed. FIG. 4A shows a jig 410 that used to ensure that the material is removed from the correct area of the cartridge. The jig 410, has an area 420 that is shaped to receive the cartridge and to hold the cartridge snug. The jig 410 has a guide hole 430 that is located above the chip holding area of a cartridge placed in the jig. The hole has predetermined thickness. FIG. 4*b* shows a bottom view of the jig 410 and the guide hole 430. After placing the cartridge in the jig 410, the remanufacturer or refiller turns the jig over exposing the bottom side of the guide hole 430. The remanufacturer then drills the cartridge holding area using a drill having a drill bit 440 by using the guide hole to drill in the correct area (FIG. 4C). The drill bit 440 may have a chamfered or beveled tip in order to drill a smoother hole in an imaging cartridge made of a soft material. The drill bit 440 has a stop collar 440 (FIG. 4D). The stop collar is placed at a predetermined distance 460 from the tip of the drill bit 440. The stop collar 450 in combination with the guide hole 430 allows the drill to drill to a predetermined depth, preventing removal of the keying structures.

Figure 4E:
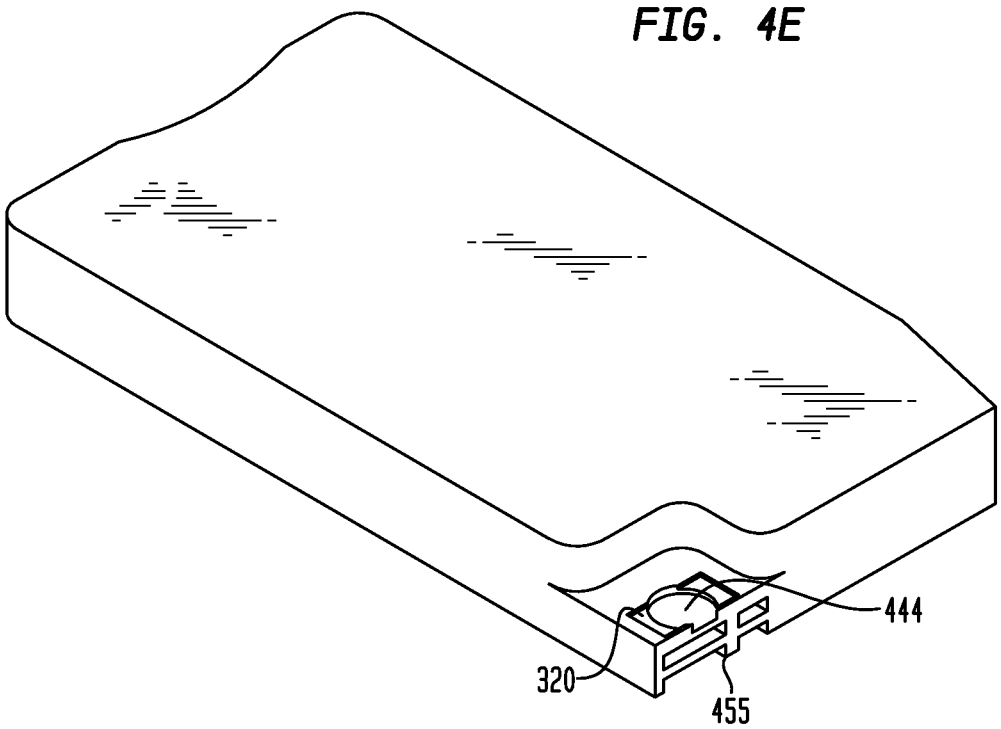
FIGS. 4E and 4F show a cartridge having a chip holding area enlarged using the kit of FIGS. 4A-4D.
Figure 4F:
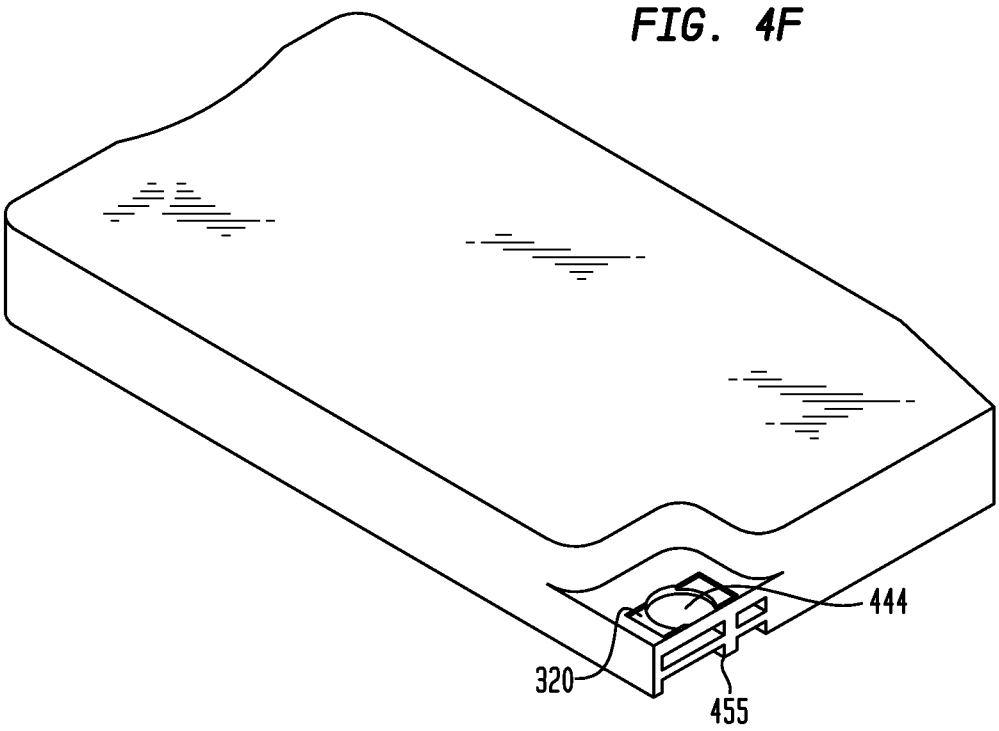

FIGS. 4E and 4F show a cartridge that has had a portion of the chip holding area removed as described above. In FIG. 4E, the hole 444 will allow for a chip to sit closer to the surface of the holding area by expanding the depth of the pocket 320. FIG. 4F illustrates a cartridge in which the hole 445 does not cut into the end surface of the cartridge. In both cases, the keying structure 455 has been left completely intact, allowing for the cartridge to be properly installed on the carriage.

Figure 3C:
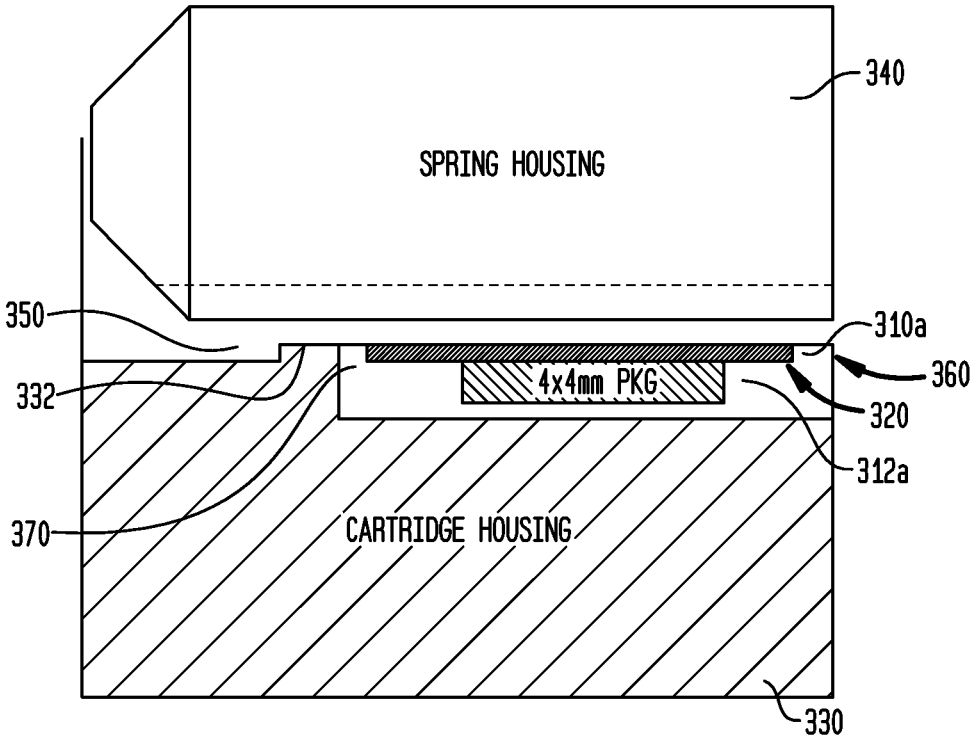
Figure 5A:
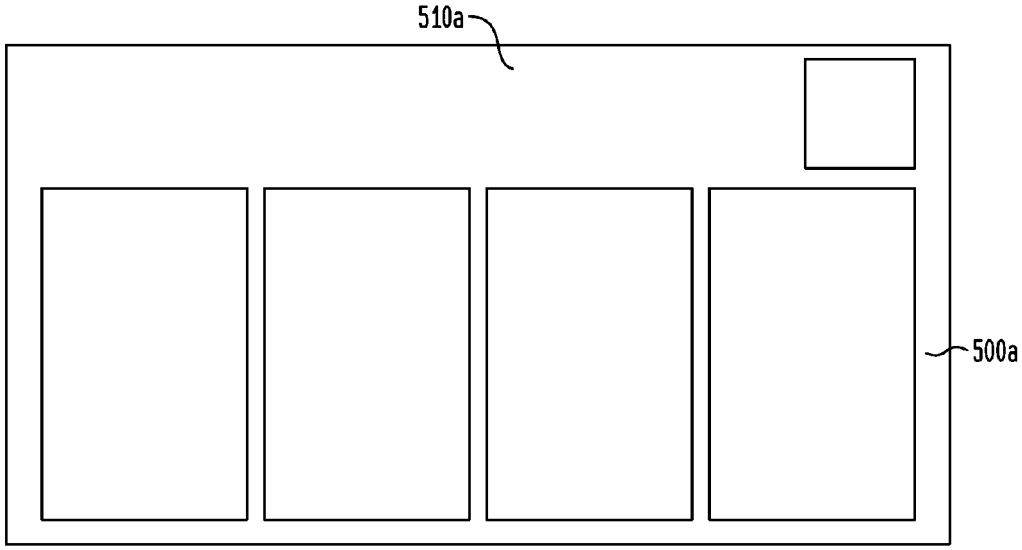
FIG. 5A-H show examples of replacement chips.
Figure 5B:
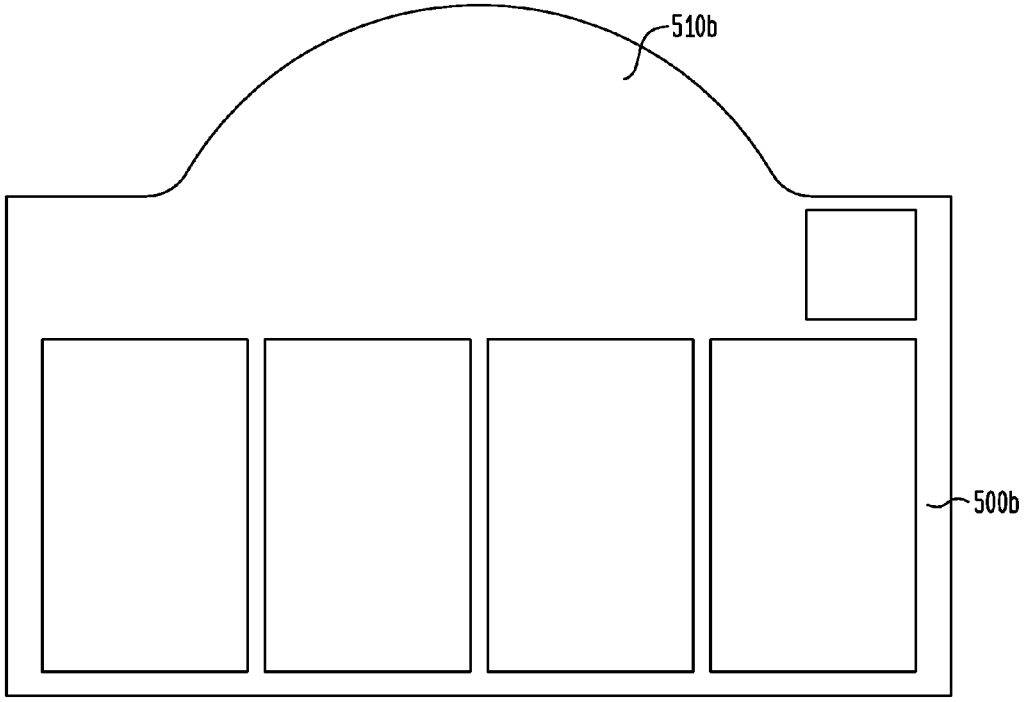
Figure 5C:
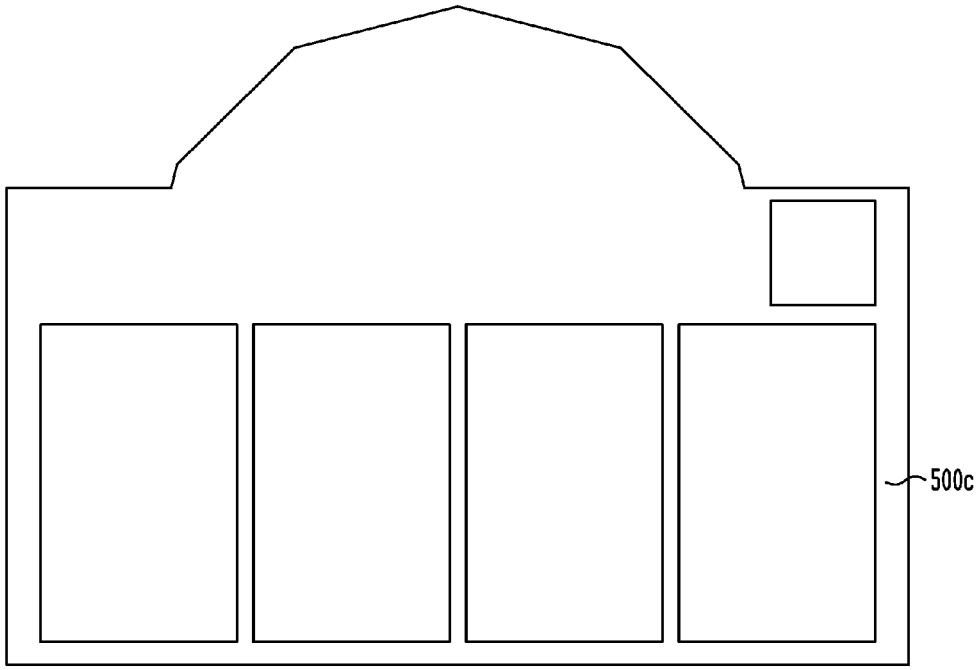
Figure 5D:
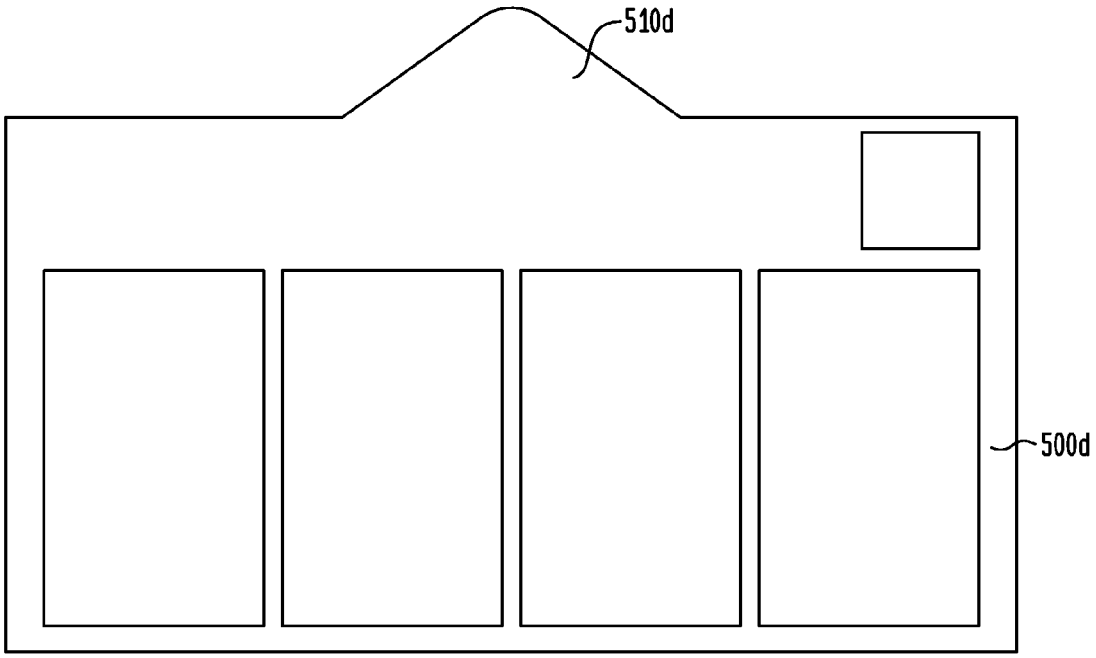
Figure 5E:
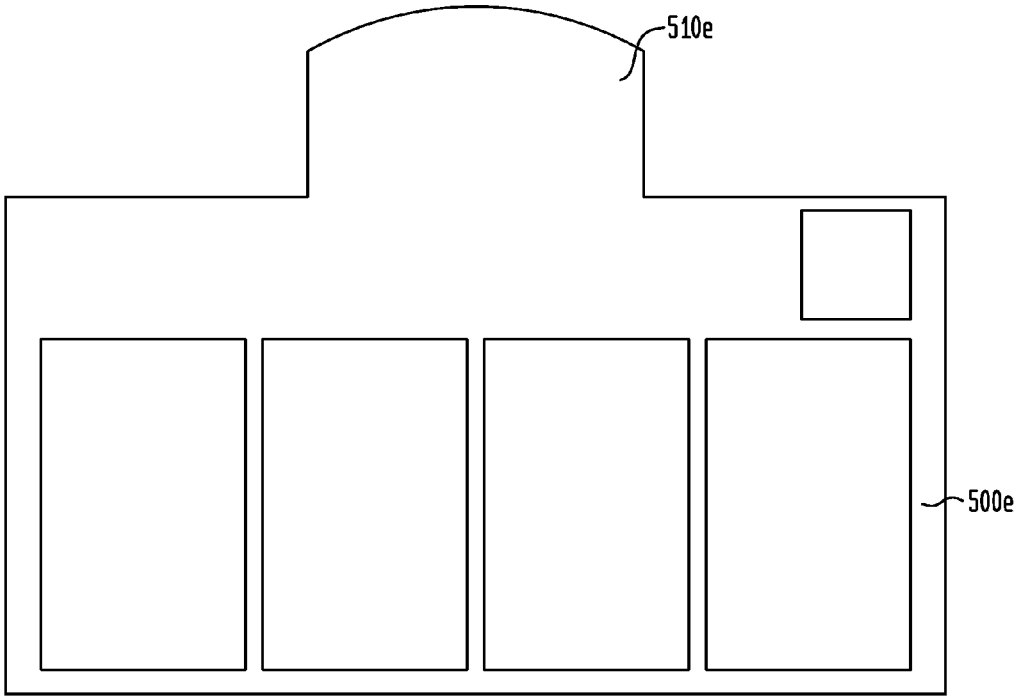
Figure 5F:
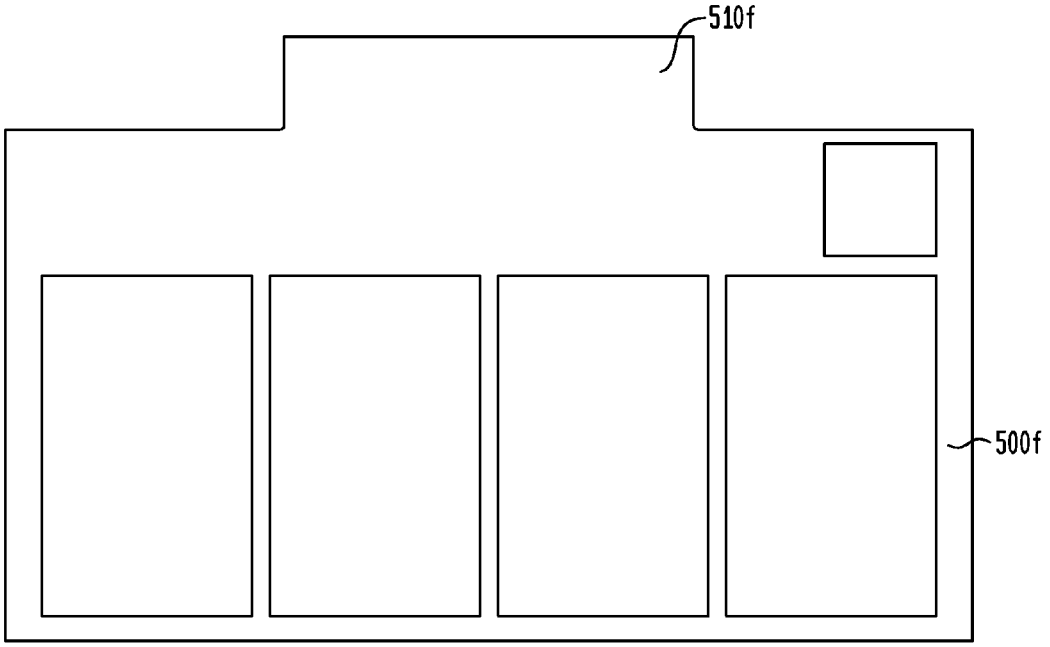
Figure 5G:
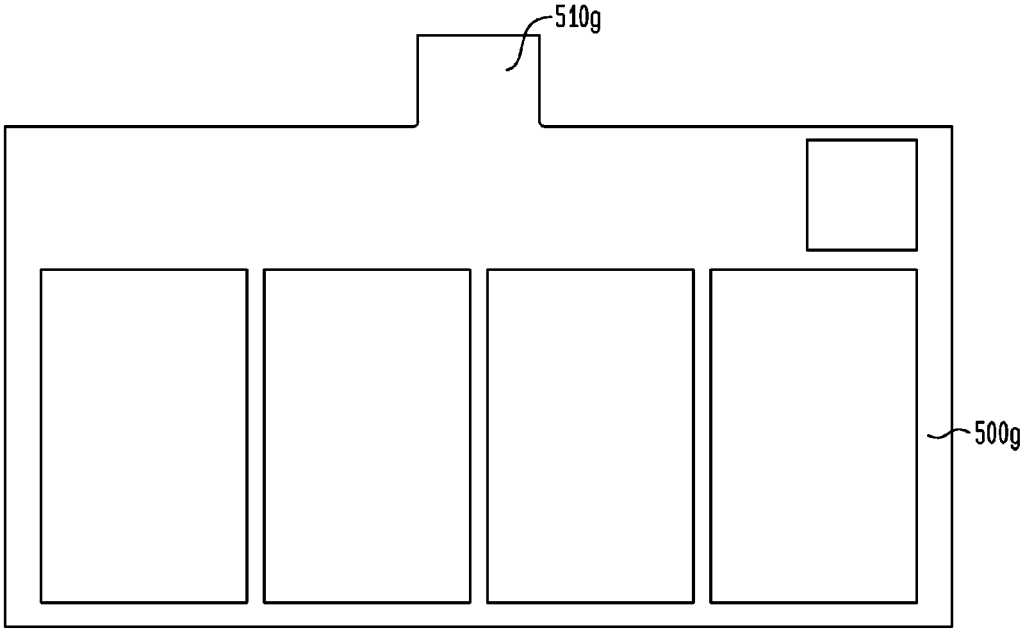
Figure 5H:
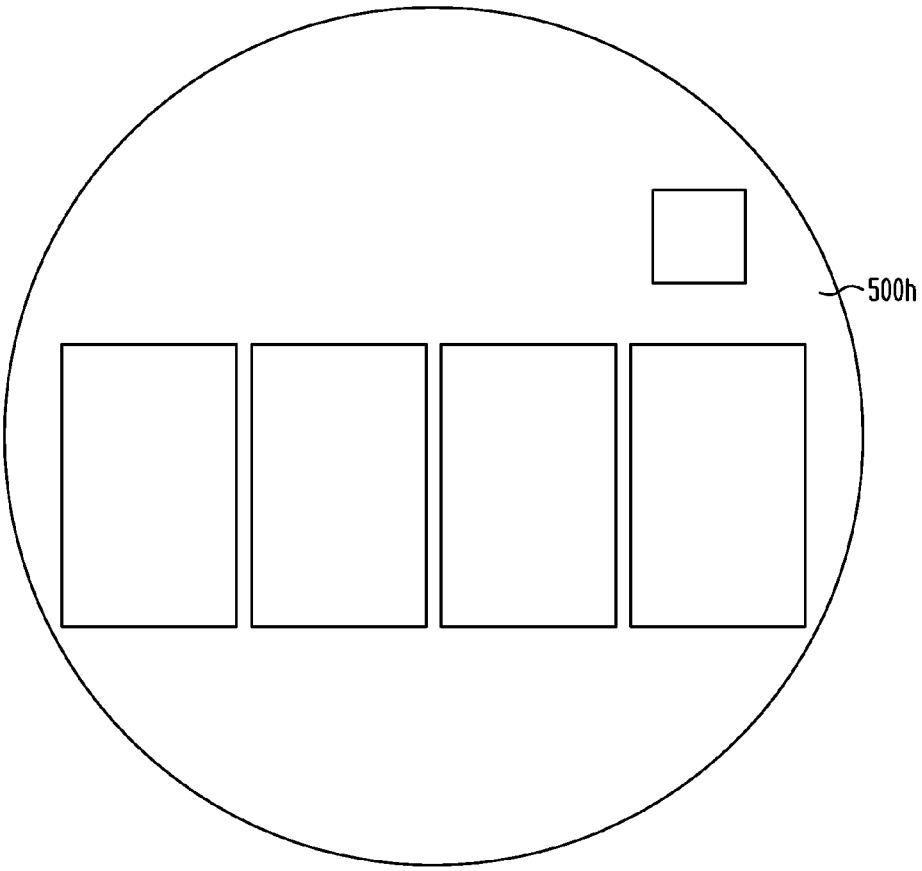

FIG. 3C illustrates a perspective view of a chip mounted into an enlarged chip pocket. The replacement chip 310*a* has a chip package 312*a* located on a surface opposite the surface having the electrical contacts. The chip package 312*a* is too thick preventing the replacement chip 310*a* from fitting in the chip pocket 320 to sit flush with a surface 332 of the cartridge housing 330. Therefore, the chip pocket is expanded 360, by the method described above or by one or more of the methods that are described below, to allow for the replacement chip 310*a* to sit lower. The spring housing 340 is located on the printer carriage and includes one or more spring contacts 350. In operation, when the cartridge is inserted into the carriage, the spring contact 350 is pushed against the cartridge housing 330 at the chip holding surface 332. Because the replacement chip 310*a* does not extend too far above the surface 332, the spring contact 350 does not catch on the replacement chip 310*a*. But, if the cut-out 360 that expands the chip pocket is too large, a gap 370 may be left exposed. For example, if the drill bit 440 creates a hole that is not fully covered by the replacement chip the result is a gap 370. If this gap is large enough, then the spring contact 350 may be pushed into the gap. This can result in either the spring contact 350 being damaged or the replacement chip 310*a* being pulled of the cartridge housing. Therefore, it is important to ensure that if there is a gap 370 that the gap is filled One method of filling gap is to fill the gap with a material such as an adhesive. Any material that has a suitable hardness may be used to fill the gap. Another technique to fill the gap is to use a chip that has a chip shape that covers the gap. FIGS. 5A-G illustrate examples of replacement chips. FIG. 5*a* shows a replacement chip 500*a* having a portion 510*a*. This portion may cover a gap created when the chip holding pocket is enlarged. FIG. 5*b* illustrates a replacement chip 500*b* having a portion 510*b*. This portion may cover a gap created when the chip holding pocket is enlarged. FIG. 5*c* shows a replacement chip 500*c* having a portion 510*c*. This portion may cover a gap created when the chip holding pocket is enlarged. FIG. 5*d* illustrates a replacement chip 500*d* having a portion 510*d*. This portion may cover a gap created when the chip holding pocket is enlarged. FIG. 5*e* shows a replacement chip 500*e* having a portion 510*e*. This portion may cover a gap created when the chip holding pocket is enlarged. FIG. 5*f* illustrates a replacement chip 500*f* having a portion 510*f*. This portion may cover a gap created when the chip holding pocket is enlarged. FIG. 5*g* illustrates a replacement chip 500*g* having a portion 510*g*. This portion may cover a gap created when the chip holding pocket is enlarged. FIG. 5H illustrates a replacement chip 500*h* that is generally circular. This allows for the replacement chip 500*h* to fit into the hole formed by the drill.

Figure 6:
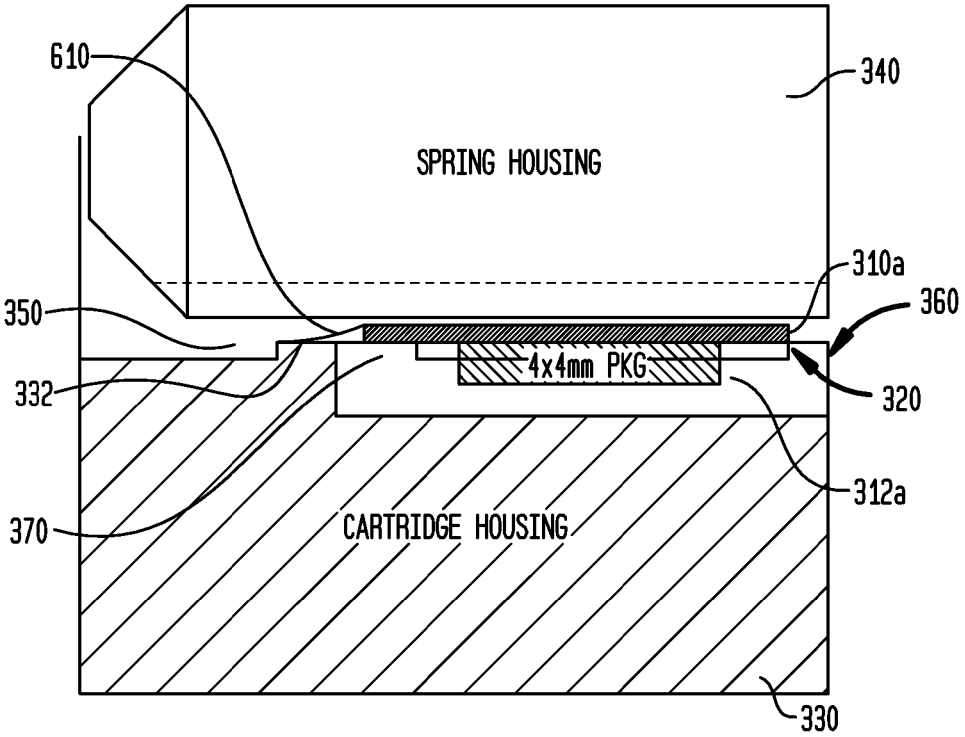
FIG. 6 shows a cross-sectional view of a modified chip holding structure in accordance with the present invention.

In the examples illustrated above, if the replacement is too large in one dimension, or the holding pocket is not enlarged enough, then the replacement chip may not sit flush with the surface of the chip holding area. FIG. 6 shows a solution to this problem. In FIG. 6, the replacement chip 312*a* sits above the chip holding area surface 332. As described above, this may cause the electrical contacts 350 to be damaged or for the replacement chip to be pulled from the cartridge. A thin flexible member 610 is placed over a surface of the replacement chip and the surface 332 of the chip holding area. The thin flexible member 610 creates a sloped surface, like a ramp, that guides the spring contact 350 onto the surface of the replacement chip 312*a*. This prevents the spring contact 350 from getting on the edge of the replacement chip.

Another advantage of using the thin flexible member 610 is that the flexible member further secures the replacement chip to the chip holding area. In fact, if the thin flexible member is strong enough with a strong adhesive, then it may be possible to secure the replacement chip only using the thin flexible member. Furthermore, the thin flexible member also covers any gap 370 that may be present. The thin flexible member can prevent the need to use a material to fill the gap. Additionally, using the thin flexible member in addition to one of the replacement chips shown if FIGS. 5A-5H provides even more coverage for the gap.

The thin flexible member 610 may be a polyester tape with an adhesive on one side. Any suitable material may be used to make the thin flexible member. Additionally, the thin flexible member may include one or more flexible conductive areas and be used to electrically connect the replacement chip to the spring contact.

Figure 7:
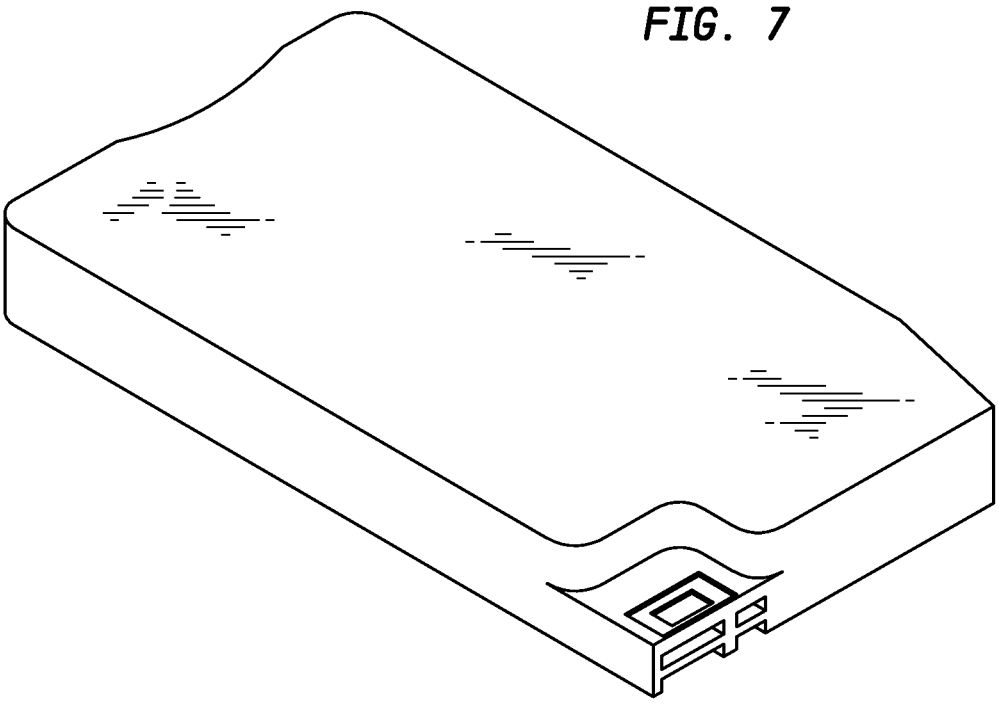
FIG. 7 shows another embodiment in which a portion of the chip holding area is removed.

FIG. 7 illustrates another embodiment in which the chip holding area is enlarged by cutting a small pocket can be cut into the cartridge housing to permit a protective area for the components on the replacement chip to be located. The chip is then mounted, components downward to provide a smooth, low profile surface to be externally exposed without concern to any height interferences during handling, installation, operation, or removal. The pocket may be cut into the cartridge body using a variety of different tools, both automatic and hand tools such as a grinder, mill, dremel, a laser, or any other suitable cutting device. The depth of the cut cannot exceed the wall thickness of the cartridge housing or remove the keying structure. The replacement chip is then mounted onto the cartridge body in the same location as the original chip with the components faced downwards and protected in the cut-out area. The chip can be secured by using a thin film member, an adhesive or glue such as a hot melt material. Any of the chips illustrated in FIGS. 5A-5H may be suitable for this method.

Figure 8:
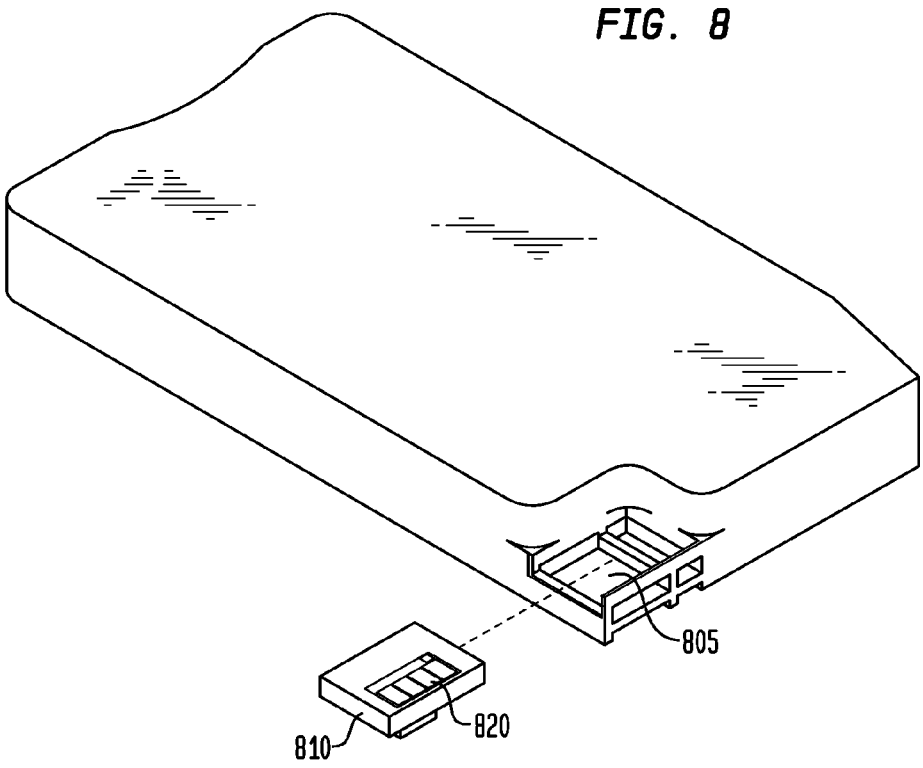
FIG. 8 shows another embodiment in which a portion of the chip holding area is removed.

FIG. 8 illustrates another embodiment in which the chip holding area is enlarged by cutting a large pocket 805. This large pocket 805 allows a structure 810 having a replacement chip 820 within it to be mounted in the large pocket 805. The structure 810 is affixed to the cartridge by any suitable means and the chip is held securely in place by the structure 810.

Figure 9:
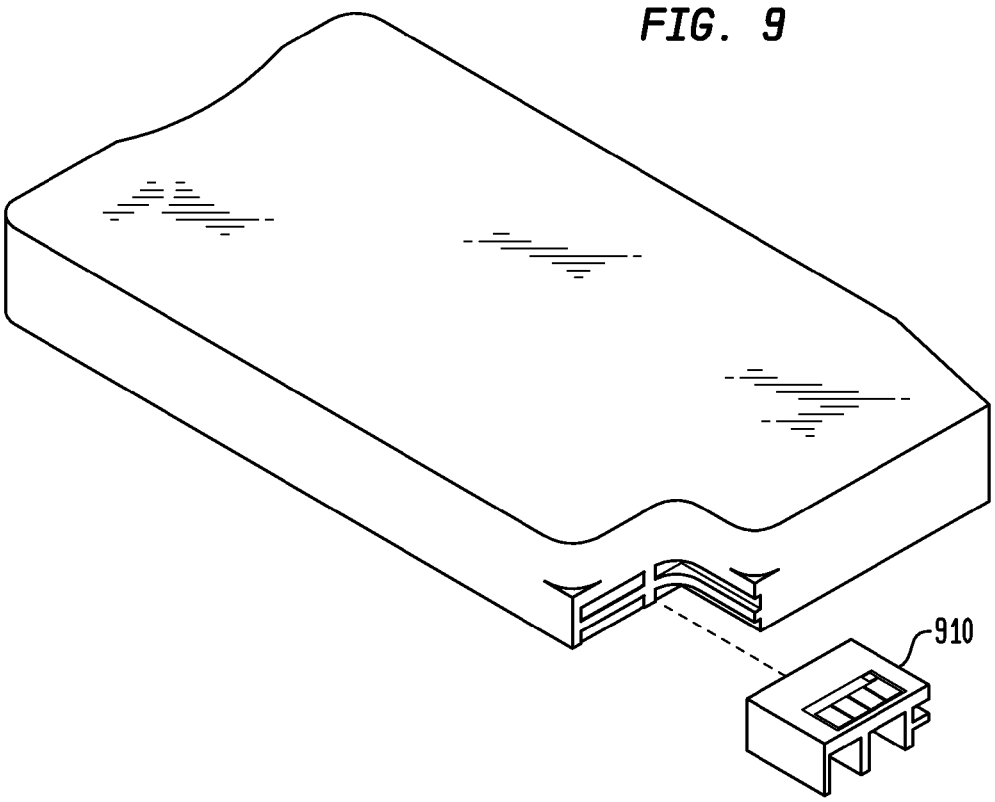
FIG. 9 shows an embodiment in which the entire chip holding area is removed and replaced with a fixture.

FIG. 9 illustrates another embodiment in which the entire chip holding area, including the keying structures, are removed. In this embodiment, a replacement structure 910, including all of the elements that were removed (such as the keying structures) is attached onto the cartridge. This allows for a cartridge to be fitted into the structure 910.

Although the methods described above refer to providing a replacement chip on a refilled or remanufactured imaging cartridge, the methods may be utilized to replace the chip on a new and unused imaging cartridge. For example, users sometimes change the ink used in an ink cartridge, change the toner used in a toner cartridge, or add more recording material (ink or toner). In those situations it is advantageous to provide a replacement chip that accurately reflects the characteristics of the recording material and the quantity of the recording material.

Although specific embodiments have been illustrated and described herein, those of ordinary skill in the art appreciate that any arrangement that is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A method of modifying an imaging cartridge comprising the steps of:

providing the imaging cartridge comprising a body including a circuit holding structure sized to hold an electronic circuit;

providing a jig having a cartridge receiving area that is shaped to receive the imaging cartridge and a guide hole;

placing the imaging cartridge in the cartridge receiving area, wherein the circuit holding area is located adjacent the guide hole of the jig;

providing a removal tool for removing a portion of the circuit holding structure; and guiding the removal tool using guide hole to remove a predetermined amount of material from the circuit holding structure.

2. The method of claim 1 wherein the removal tool is a drill bit having a stop collar and the stop collar engages the guide hole to limit a depth of drilling.

3. The method of claim 1 further comprising the step of attaching a replacement chip in the circuit holding area.

4. The method of claim 3 further comprising placing a flexible thin film member over a portion of the replacement chip and a portion of the circuit holding structure.

5. The method of claim 1 wherein there is a gap formed by removing a portion of the circuit holding area and a portion of the replacement chip covers the gap.

6. The method of claim 1 wherein there is a gap formed by removing a portion of the circuit holding area and the gap is filled with a material.

7. The method of claim 1 wherein there is a gap formed by removing a portion of the circuit holding area and the gap is covered by a flexible thin film member.

* * * * *